US007540308B2

(12) United States Patent
Pessin et al.

(10) Patent No.: US 7,540,308 B2
(45) Date of Patent: Jun. 2, 2009

(54) METHOD OF SUPPLYING A POWDERED CHEMICAL COMPOSITION TO A WELLSITE

(75) Inventors: Jean-Louis Pessin, Houston, TX (US); Ismail El Kholy, Sugar Land, TX (US); Gregoire Jacob, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 507 days.

(21) Appl. No.: 11/146,596

(22) Filed: Jun. 7, 2005

(65) Prior Publication Data

US 2006/0272735 A1 Dec. 7, 2006

(51) Int. Cl.
*B65B 1/20* (2006.01)
*E21B 43/267* (2006.01)

(52) U.S. Cl. ..... 141/11; 141/69; 141/70; 166/278; 166/280.2

(58) Field of Classification Search ..... 141/2, 141/11, 67, 69, 70, 285; 166/278, 280.2, 166/285, 162, 168; 523/131
See application file for complete search history.

(56) References Cited

U.S. PATENT DOCUMENTS 2,854,407 A * 9/1958 Mallory ..... 507/110
4,172,539 A 10/1979 Botkin ..... 222/195
4,325,495 A * 4/1982 Mokris ..... 222/1
4,512,405 A * 4/1985 Sweatman et al. ..... 166/278
4,556,173 A 12/1985 Pausch et al. ..... 239/533.13
4,569,394 A * 2/1986 Sweatman et al. ..... 166/280.1
4,662,543 A 5/1987 Solimar ..... 222/195
4,780,243 A * 10/1988 Edgley et al. ..... 516/11
4,821,782 A 4/1989 Hyer ..... 141/83
5,071,289 A * 12/1991 Spivak ..... 406/11
5,133,624 A * 7/1992 Cahill ..... 405/129.4
5,497,873 A 3/1996 Hay ..... 198/642
5,526,879 A * 6/1996 Champ et al. ..... 166/278
5,727,607 A * 3/1998 Ichikawa et al. ..... 141/67
5,833,092 A 11/1998 Godfrey et al. ..... 222/168
6,021,821 A * 2/2000 Wegman ..... 141/93
6,170,976 B1 1/2001 Sisk ..... 366/101
6,205,931 B1 3/2001 Degutis et al. ..... 105/248
6,311,745 B1 * 11/2001 Welch et al. ..... 141/346
6,558,111 B2 5/2003 Wilson et al. ..... 414/810
7,283,772 B2 * 10/2007 Amano et al. ..... 399/258

* cited by examiner

*Primary Examiner*—Timothy L Maust
(74) *Attorney, Agent, or Firm*—Michael Flynn; David Cate; Robin Nava

(57) ABSTRACT

A method of conditioning a compacted polymeric powder to a flowable and meterable state. The polymeric powder is compacted during transport such that the flowability is hindered. To increase flowability, gas is introduced into the polymeric powder to condition the same to an improved flowable and meterable state.

20 Claims, 2 Drawing Sheets

METHOD OF SUPPLYING A POWDERED CHEMICAL COMPOSITION TO A WELLSITE

FIELD OF THE INVENTION

The present invention relates to methods of conditioning compacted powdered chemical compositions, and in particular, to improving the flowability of compacted powdered chemical compositions for use in treating a subterranean formation.

BACKGROUND OF THE INVENTION

Chemical compositions are used in subterranean operations for such purposes as the development and completion of wellbores that penetrate subterranean formations, and the production of gaseous and liquid hydrocarbons from natural reservoirs. These operations include perforating subterranean formations, fracturing subterranean formations, modifying the permeability of subterranean formations, or even controlling the production of sand or water from subterranean formations. Some compositions employed in these oilfield operations are commonly known as drilling compositions, completion compositions, work-over compositions, packer compositions, fracturing compositions, stimulation compositions, conformance or permeability control compositions, consolidation compositions, and the like. Often such chemical compositions are additives, crosslinkers, or polymer compositions, and in the case of viscosifying agents, may be agents such as guar, guar-derived polymer compositions, cellulose, or cellulose-derived polymer compositions. These chemical compositions are generally transported to wellsites, where a wellbore is located, slurried in a fluid carrier, such as diesel fuel, or mineral oil, for example.

The use of a fluid carrier, however, has drawbacks. For example, the use of a fluid carrier increases the cost of the polymer composition. The fluid carrier to suspend the polymer composition must be purchased, along with any other agents required to aid in wetting the polymer composition upon mixing with water at the wellsite. Additionally, the use of a fluid carrier increases the weight of the polymer composition and thereby increases the transportation costs. Furthermore, depending on the type of fluid carrier used, there may be environmental regulations regarding exposure to the fluid carrier. Thus, it would be advantageous to avoid the use of a fluid carrier to transport chemical compositions to wellsites for subterranean treatment operations.

SUMMARY OF THE INVENTION

To alleviate one or more disadvantage associated with the use of a fluid carrier, the invention is directed toward supplying chemical compositions in substantially dry form (e.g. in powder form) for subterranean treatment operations. The inventors have discovered that some chemical compositions, such as viscosifying polymer compositions, crosslinkers, additives, chelants, surfactant, delay agents, proppants, breakers, and the like, in powder form can become compacted for various reasons and particularly tend to become compacted due to vibrations which occur during transport. Compacting can decrease the flowability and/or prevent the powder chemical composition from adequately flowing out of a container. Such a decrease in flowability also may lead to metering accuracy concerns. To improve the flowability of the powdered chemical composition, the inventors have discovered that introducing a gas into the powdered chemical composition improves the flowability. As flowability is improved, metering of the dry chemical composition may also be improved.

In one aspect of the invention, a method of supplying a powdered chemical composition to a wellsite for treating a subterranean formation is disclosed. The method includes the steps of (1) introducing a powdered chemical composition into a container at a first location; (2) transporting the container including the powdered chemical composition to a second location different than the first location; (3) introducing a gas flow into the powdered chemical composition within the container; and (4) discharging the powdered chemical composition from the container; whereby the metering of the powdered chemical composition after discharge is improved.

In another aspect of the invention, a method of increasing the flowability of a compacted powder chemical composition is disclosed. The method includes the steps of (1) retaining a compacted powder chemical composition having a bulk density of a first value in a container; and (2) altering the bulk density of the compacted polymeric powder composition within the container to a second value, the second bulk density value being less than the first bulk density value thereby resulting in an increased flowability of the polymeric powder composition upon discharge from the container.

In yet another aspect of the invention, a method of delivering a powdered polymer chemical composition is disclosed. The method includes the steps of (1) transporting a guar based powdered polymer chemical composition to a wellsite in a container; (2) aerating the powdered polymer chemical composition within the container with a plurality of air flows introduced into the container; (3) reducing the bulk density of the powdered polymer chemical composition with the introduced air flows; and (4) discharging the reduced bulk density powdered polymer chemical composition from the container.

In a further aspect of the invention, another method of delivering a powdered polymer chemical composition to a wellsite is disclosed. The method includes the steps of (1) transporting a guar based powdered polymer chemical composition to a wellsite in a container; (2) aerating the powdered polymer chemical composition within the container with a plurality of air flows introduced into the container; (3) discharging the powdered polymer chemical composition from the container; and, (4) metering the powdered polymer chemical composition after discharging from the container.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses. Illustrative embodiments of the invention are described below. In the interest of clarity, not all features of an actual implementation are described in this specification. It will of course be appreciated that in the development of any such actual embodiment, numerous implementation specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

Chemical compositions, such as viscosifying polymer compositions, crosslinkers, additives, chelants, surfactants, delay agents, proppants, breakers, and the like, in powder form can become compacted for various reasons and particularly tend to become compacted due to vibrations which occur during transport. Compacting of the powdered chemical composition can decrease the flowability and/or prevent the powdered chemical composition from adequately flowing out of a container. To improve the flowability of the powdered chemical composition, the inventors have discovered that introducing gas into the powdered chemical composition improves the flowability. As flowability is improved, metering of the powdered chemical composition may also be improved. As used herein, the term "viscosifying polymer compositions" means any suitable polymer compositions for treating a subterranean formation, such as, by non-limiting example, guar, guar-derived polymers, cellulose, cellulose-derived polymers, xanthan gum, or synthetic polymers such as polyacrylamides and polyacrylamide copolymers, and the like.

Figure 1:
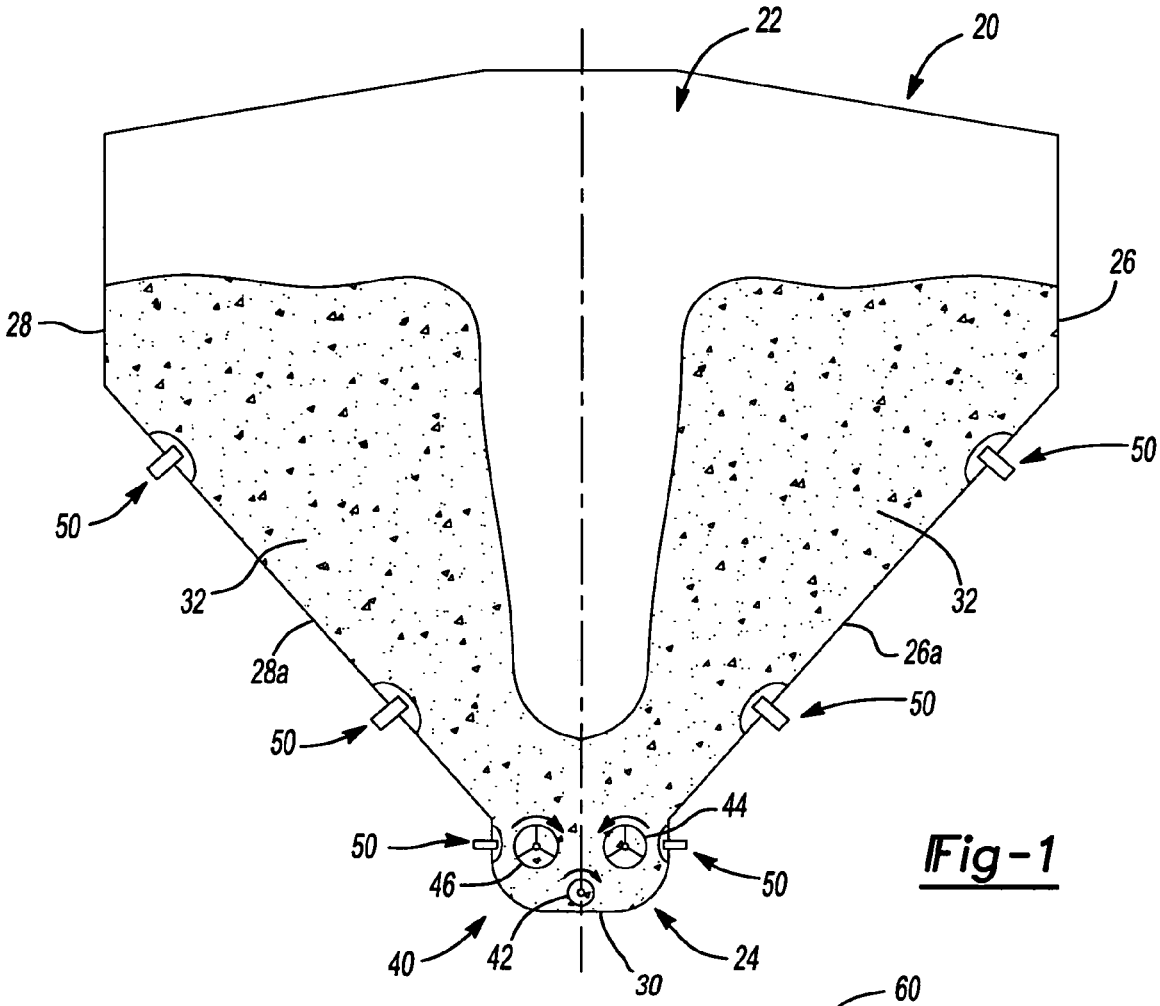
FIG. 1 is a schematic cross-sectional representation of a transport container including apparatus for introducing gas into a viscosifying polymer powder within the transport container.

Referring to FIG. 1, a schematic cross-section of a container 20 suitable for supplying a powdered chemical composition to a desired location, such as a wellsite, is shown. Container 20 can be loaded with the powdered composition 32 at one location, such as a supply location, and preferably transported in the container to a wellsite for subsequent discharge of the powdered chemical composition 32. Container 20 has an interior cavity 22 with a lower discharging/feeder portion 24. Cavity 22 is defined by longitudinally extending sidewalls 26, 28 and a bottom surface 30. Each sidewall 26, 28 has a tapering portion 26*a*, 28*a* that taper toward each other as they extend toward bottom surface 30. Tapering portions 26*a*, 28*a* facilitate the flow of powdered composition 32 within cavity 22 toward discharge portion 24.

A metering device/apparatus 40 is disposed within discharge portion 24 of cavity 22. Metering device 40 controls the quantity and rate at which a powdered chemical composition 32 is discharged from container 20. Metering device 40 includes a longitudinally extending metering screw 42 and a pair of longitudinally extending agitators 44, 46 that help feed the powdered chemical composition 32 into metering screw 42.

A plurality of devices 50 for introducing gas to the powdered chemical composition 32 are located at various locations along the container 20. As illustrated, the devices 50 are preferably located along sidewalls 26, 28 and in proximity to the discharge portion 24. As will be discussed in more detail below, the introduction of gas, such as, by non-limiting example, air, nitrogen, carbon dioxide, and the like, into the powdered chemical composition 32 reduces the bulk density of the powdered chemical composition 32 within container 20 and increases the flowability of the composition at the time of discharge. FIG. 1 also illustrates that during the discharge of a compacted powdered chemical composition 32, in the absence of introduction of gas, the centrally located portion of the powdered composition 32 may have greater flowability than the outer portions, thus forming a central columnar cavity during the transfer.

The devices 50 can take a variety of forms. For example, the devices 50 can include one or more nozzles, one or more elastomeric cups attached to the interior of container 20 in which compressed air is injected under the cups, and one or more permeable membranes, such as a felt cloth or finely divided, consolidated metal particles (porous metal) or a finely perforated pad through which the gas can be injected into container 20. Other examples of possible gas introduction devices include those disclosed in U.S. Pat. No. 4,172,539 to Botkin for "AERATOR NOZZLE," issued Oct. 30, 1979; U.S. Pat. No. 4,556,173 to Pausch et al. for "BIN FLUIDIZER," issued Dec. 3, 1985; U.S. Pat. No. 4,662,543 to Solimar for "AERATION DEVICE FOR ASSISTING IN AERATION OF MATERIAL FROM CONTAINERS," issued May 5, 1987; and U.S. Pat. No. 6,170,976 to Sisk for "PREASSEMBLED FLUIDIZING DEVICE HAVING EXPANSIVE AIR PASSAGE STIMULATING ENHANCED FLOW OF GRANULAR MATERIALS IN TANK TRAILERS AND CONTAINERS," issued Jan. 9, 2001.

Figure 2:
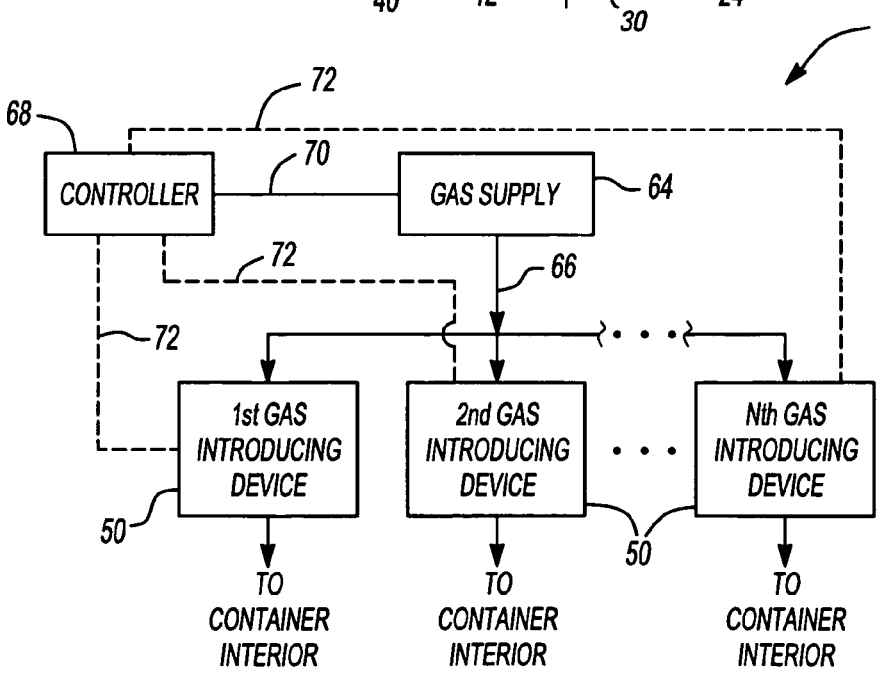
FIG. 2 is a schematic representation of a gas supply system for use with the container of FIG. 1 according to the principles of the present invention.

Referring now to FIG. 2, a schematic of a gas supply system 60 for supplying gas flow to gas introduction devices 50 is shown. Gas supply system 60 includes a gas supply 64. Gas supply 64 can be an integral part of container 20, a vehicle for transporting the container, or a separate component attached to the container prior to discharge. Regardless of the location, gas supply 64 is operable to supply a gas flow to each gas device ($1^{st}$ to the $N^{th}$) 50 via appropriate supply plumbing 66. A selectively operable controller 68 controls the operation of gas supply 64 and/or each gas introduction device 50. Controller 68 can also take a variety of forms. For example, controller 68 can be as simple as one or more manually operable open/close or proportional valve(s). Alternately, if greater control is desired, controller 68 can be an electrical or pneumatic controller that can automatically individually control gas supply 64 and/or each gas introduction device 50 via appropriate connections 70, 72, respectively, therebetween. Regardless of the type of controller utilized, gas supply system 60 is operable to selectively supply gas flows to gas introduction devices 50 as needed. By the phrase "selectively supply," it is meant that gas flows can be a steady stream of gas, pulsed flows of gas or a combination thereof, in patterned or random order.

The methods of the present invention are applicable to a variety of powdered chemical compositions, such as viscosifying polymer compositions for well treatment fluids by way of non-limiting example. Preferred types of viscosifying polymer compositions may include any suitable polymer compositions, such as, by non-limiting example, guar, guar-derived polymers, cellulose, and cellulose-derived polymers. The viscosifying polymer in substantially dry form (powder) is typically ground to very small dimensions. Preferably, the median particle size of the viscosifying polymer is in the range of from about 40 to about 60 microns. This small particle size aids in the rapid hydration and viscosification of the well treatment fluid, and facilitates continuously mixing a fluid. The bulk density of the viscosifying polymer is generally in the range of from about 500 to about 700 kilograms per cubic meter.

During transport of powdered chemical composition 32 from a supply location to the wellsite, vibrations of the container 20 can cause the powdered chemical composition 32 to become compacted. Specifically, the bulk density of the powdered chemical composition is increased due to the induced vibrations during movement of container 20 to the wellsite. Bulk density of the powdered chemical composition varies with the consolidating pressure. The permeability, as measured with air flow through the powdered chemical composition, varies inversely with the bulk density. It is believed that the increase in bulk density increases the consolidation strength of the powdered chemical composition such that flow of the powdered chemical composition at discharge, generally through a metering device 40 is reduced or ceases altogether. It has been found that the introduction of a gas, such as compressed air, into the powdered polymer composition, especially at the bottom of the compacted powdered chemical composition in container 20, substantially reduces the bulk density and improves the flowability of the powdered chemical composition.

Figure 3:
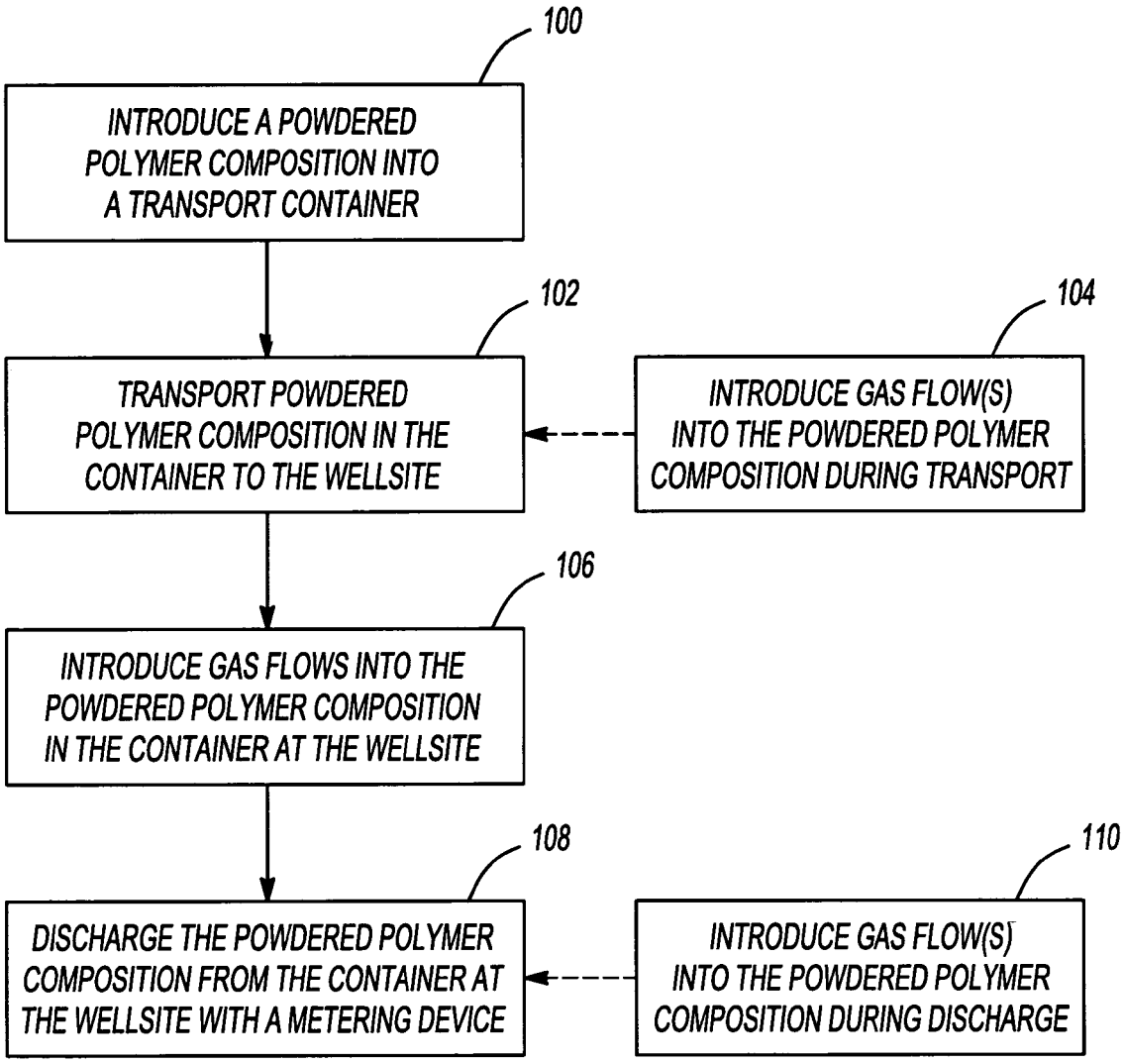
FIG. 3 is a flowchart of a method of conditioning a compacted polymeric powder to a flowable state according to the principles of the present invention.

Referring to FIG. 3, the transporting and delivery of a powdered polymer composition from a supply location to a wellsite is shown. The powdered polymer composition is packed into transport container 20, as indicated in block 100. Container 20 is then transported from the supply site to the wellsite, as indicated in block 102. Container 20 can be transported over the roadway and/or railways or other suitable means of transport. During transport vibrations are induced into the powdered polymer composition in container 20. The vibrations cause the bulk density of the powdered polymer composition to become compacted within container 20 which increases the bulk density of the powdered polymer composition. Optionally, as indicated in block 104, gas flows can be introduced into the powdered polymer composition during transport via gas devices 50. When the gas is introduced into container 20 during transport, a suitable gas supply 64 is included either with container 20 and/or the vehicle transporting container 20.

Upon arriving at the wellsite, gas can also be introduced into the powdered polymer composition in container 20, as indicated in block 106. If needed, a local gas supply 64 is connected to supply plumbing 66. Controller 68 is then operated to cause gas supply 64 to supply gas flows to gas devices 50 which then flow into container 20. The gas flows flow through the powdered polymer composition therein and decreases the bulk density of the powdered polymer composition. This operation thereby conditions the compacted powdered polymer composition to an improved flowable state.

Once the powdered polymer composition is flowable, metering device 40 can be operated to discharge the powdered polymer composition from the container at the wellsite, as indicated in block 108. Optionally, as indicated in block 110, the gas flows can continue to be introduced into the powdered polymer composition during the discharging operation.

Accordingly, the present invention facilitates the use of a viscosifying powdered polymer composition in dry form at a wellsite. The transport of the polymer composition in dry form eliminates the cost of purchasing and disposing of a liquid carrier. Additionally, the injection of gas flow into the polymer composition within container 20 conditions the polymer composition to a flowable state. The use of such gas flows thereby minimizes the concern of vibrational compacting that occurs to the polymer composition during transport.

Methods of the invention are useful in subsurface operations, including such operations as fracturing subterranean formations, modifying the permeability of subterranean formations, fracture or wellbore cleanup, acid fracturing, matrix acidizing, gravel packing or sand control, and the like. Another application includes the placement of a chemical plug to isolate zones or to assist an isolating operation.

When used in fracturing operations, techniques for hydraulically fracturing a subterranean formation will be known to persons of ordinary skill in the art, and will involve pumping a fracturing composition, often including a powdered chemical composition, into the borehole and out into the surrounding formation. The fluid pressure is above the minimum in situ rock stress, thus creating or extending fractures in the formation. See Stimulation Engineering Handbook, John W. Ely, Pennwell Publishing Co., Tulsa, Okla. (1994), U.S. Pat. No. 5,551,516 (Normal et al.), "Oilfield Applications", Encyclopedia of Polymer Science and Engineering, vol. 10, pp. 328-366 (John Wiley & Sons, Inc. New York, N.Y., 1987). In the fracturing treatment, the compositions delivered by methods of the invention fluids may be delivered in the pad treatment stage, the proppant stage, or both. The fracturing materials are preferably mixed on the surface. Alternatively, the materials may be mixed downhole.

Methods of the invention may be useful for delivering powdered chemical compositions for cleanup operations. The term "cleanup" or "fracture cleanup" refers to the process of removing the fracture fluid (without the proppant) from the fracture and wellbore after the fracturing process has been completed. Techniques for promoting fracture cleanup traditionally involve reducing the viscosity of the fracture fluid as much as practical so that it will more readily flow back toward the wellbore. The invention may also be useful when gravel packing a wellbore.

The following example is presented to illustrate the methods of conditioning compacted powdered chemical compositions, and should not be construed to limit the scope of the invention, unless otherwise expressly indicated in the appended claims. All percentages, concentrations, ratios, parts, etc. are by weight unless otherwise noted or apparent from the context of their use.

EXAMPLE

The following example illustrates the invention, as described herein above.

A sample of a powdered viscosifying polymer composition was subjected to vibrations to determine the compaction that can be expected to occur when being transported. In the test, 100 grams of guar gum, powdered polymer composition, was placed in a 500 ml graduated cylinder. The cylinder with the sample therein was subjected to vibrations having an amplitude of 5 mm and a frequency of 10,000 Hz. The initial bulk density of the polymer composition sample was about 520 kilograms per cubic meter. After being subjected to the vibrations for a duration of two minutes, the bulk density was found to have increased to about 660 kilograms per cubic meter. The graduated cylinder was then inverted and no flow was observed from the polymer composition at the bulk density of about 660 kilograms per cubic meter.

Compressed air at a pressure of about 0.7 MPa was introduced into the bottom of the graduated cylinder through a 3.2 mm diameter tubing for 5 seconds. The introduction of the compressed air reduced the bulk density to about 590 kilograms per cubic meter. The graduated cylinder was then again inverted and the bulk density was adequate to allow the polymer composition to flow from the cylinder upon inversion.

While the present invention has been described with reference to specific embodiments, it should be appreciated that the above description is merely exemplary in nature and variations that do not depart from the gist of the invention are intended to be within the scope of the invention. For example, while metering device 40 is shown as including a metering screw 42 and two agitators 44, 46, it should be appreciated that other types of metering devices could be employed. Additionally, while container 20 is shown as having a specific configuration, it should be appreciated that the configuration of transport container 20 can take a variety of forms and still be within the scope of the present invention. Moreover, while a specific polymer composition having specific physical properties is disclosed, it should be appreciated that other powdered polymeric compositions, or powdered chemical compositions can also be employed and utilized with the methods of the present invention. Thus, such variations are not to be regarded as a departure from the spirit and scope of the invention.

What is claimed is:

1. A method of supplying a powdered chemical composition comprising:

(a) introducing a powdered chemical composition into a container at a first location;

(b) transporting the container, including the powdered chemical composition, to a second location different than the first location, the second location corresponding to a wellsite;

(c) introducing a gas flow into the powdered chemical composition within the container;

(d) discharging the powdered chemical composition from the container at the second location through a metering device, whereby the metering of the powdered chemical composition is improved; and (e) mixing the discharged powdered chemical composition with a liquid to form a well treatment fluid.

2. The method of claim 1, wherein step (c) is carried out during step (b).

3. The method of claim 1, where step (c) is carried out after step (b).

4. The method of claim 1 wherein, step (c) is carried out during both steps (b) and (d).

5. The method of claim 1, wherein said gas flow is compressed air injected into the powdered chemical composition.

6. The method of claim 1, wherein step (a) includes introducing a guar based viscosifying polymeric powder into the container.

7. The method of claim 1, wherein step (c) includes introducing a plurality of gas flows into the powdered chemical composition at a plurality of discrete locations within the container.

8. The method of claim 1, wherein step (c) includes introducing a steady gas flow into the powdered chemical composition.

9. The method of claim 1, wherein step (c) includes introducing pulses of gas flow into the powdered chemical composition.

10. The method of claim 1 further comprising utilizing the well treatment fluid in a subsurface operation.

11. The method of claim 1 wherein discharging comprises operating the metering device to discharge the powdered chemical composition.

12. The method of claim 1 wherein the gas flow is not utilized to discharge the powdered chemical composition.

13. A method of delivering a powdered polymer chemical composition comprising:

(a) transporting a guar based powdered polymer chemical composition to a wellsite in a container;

(b) aerating the powdered polymer chemical composition within the container with a plurality of gas flows introduced into the container;

(c) reducing a bulk density of the powdered polymer chemical composition with the introduced gas flows;

(d) discharging the reduced bulk density powdered polymer chemical composition from the container through a metering device, whereby the metering of the powdered chemical composition is improved; and (e) mixing the discharged powdered polymer chemical composition with a liquid to form a well treatment fluid.

14. The method of claim 13, further comprising simultaneously performing steps (b) and (d).

15. The method of claim 13, wherein the plurality of gas flows include introducing steady gas flows into the powdered polymeric chemical composition.

16. The method of claim 13, wherein the plurality of gas flows include introducing pulses of gas into the powdered polymeric chemical composition.

17. The method of claim 13, wherein step (b) is carried out during step (a).

18. The method of claim 13 further comprising utilizing the well treatment fluid in a subsurface operation.

19. The method of claim 13 wherein discharging comprises operating the metering device to discharge the powdered polymer chemical composition.

20. The method of claim 13 wherein the gas flows are not utilized to discharge the powdered chemical polymer composition.

* * * * *